US010753293B2

(12) United States Patent
Noh et al.

(10) Patent No.: US 10,753,293 B2
(45) Date of Patent: Aug. 25, 2020

(54) METHOD FOR CONTROLLING AIR-FUEL RATIO IN IDLE PURGE-OFF MODE

(71) Applicants: Hyundai Motor Company, Seoul (KR); Kia Motors Corporation, Seoul (KR)

(72) Inventors: Tae-Gon Noh, Busan (KR); Seung-Mook You, Gyeonggi-co (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 11 days.

(21) Appl. No.: 16/188,851

(22) Filed: Nov. 13, 2018

(65) Prior Publication Data

US 2019/0178178 A1 Jun. 13, 2019

(30) Foreign Application Priority Data

Dec. 8, 2017 (KR) ..... 10-2017-0168536

(51) Int. Cl.

| | |
|---|---|
| ***F02M 1/00*** | (2006.01) |
| ***F02D 41/00*** | (2006.01) |
| ***F02D 41/24*** | (2006.01) |
| ***F02D 41/14*** | (2006.01) |
| ***F02M 25/08*** | (2006.01) |
| ***F02D 41/08*** | (2006.01) |

(52) U.S. Cl.

CPC ..... *F02D 41/0042* (2013.01); *F02D 41/0032* (2013.01); *F02D 41/0045* (2013.01); *F02D 41/08* (2013.01); *F02D 41/1455* (2013.01); *F02D 41/2454* (2013.01); *F02M 25/08* (2013.01)

(58) Field of Classification Search

CPC F02D 2250/02; F02M 25/0836; F02M 25/08; F02M 33/02

USPC ..... 123/510, 516, 518

See application file for complete search history.

(56) References Cited

U.S. PATENT DOCUMENTS

| | | | | |
|---|---|---|---|---|
| 5,143,040 | A * | 9/1992 | Okawa | F02D 41/0045 123/520 |
| 6,230,699 | B1 * | 5/2001 | Mitsutani | F02D 41/0042 123/674 |
| 6,273,063 | B1 * | 8/2001 | Saruwatari | F02D 31/003 123/339.21 |
| 6,371,089 | B1 * | 4/2002 | Matsuoka | B60K 6/365 123/519 |
| 6,446,614 | B1 * | 9/2002 | Matsuoka | F02D 29/06 123/516 |
| 2005/0154520 | A1 * | 7/2005 | Osanai | F02D 41/0032 701/60 |

* cited by examiner

*Primary Examiner* — John Kwon

(74) *Attorney, Agent, or Firm* — Mintz Levin Cohn Ferris Glovsky and Popeo, P.C.; Peter F. Corless

(57) ABSTRACT

A method for controlling an air-fuel ratio in an idle purge-off mode is provided. The method includes stopping feedback for an amount of fuel for a particular period of time when idle purging is terminated and performing freeze control with a constant lambda control value.

13 Claims, 4 Drawing Sheets

METHOD FOR CONTROLLING AIR-FUEL RATIO IN IDLE PURGE-OFF MODE

CROSS-REFERENCE TO RELATED APPLICATIONS

This application claims priority to Korean Patent Application No. 10-2017-0168536, filed on Dec. 8, 2017, which is incorporated herein by reference in its entirety.

BACKGROUND

Field of the Invention

The present invention relates to a method for controlling an air-fuel ratio in an idle purge-off mode, and more particularly, to a method for controlling an air-fuel ratio capable of preventing a revolutions per minute (RPM) decrease due to a lean peak of an air-fuel ratio in an idle purge-off mode.

Description of Related Art

Evaporated gas generated in a fuel tank is collected in a canister, and the collected evaporated gas is delivered to an engine through canister purge control while the engine operates and is used for combustion. However, when a purge learning is not appropriately performed in a high concentration canister situation, a purge flow rate and a purge gas concentration become inaccurate causing a lean peak of an air-fuel ratio in an idle purge-off mode and a revolutions per minute (RPM) decrease due to the lean peak, and potentially, a starting off occurs (see FIG. 1).

To prevent the described above, a related art increases a reserve torque during a purge operation of the canister to respond to sudden disturbance, thereby securing combustion stability, and experimentally, the RPM decrease tends to be improved as the reserve torque is increased however, an improvement effect due to an increase of the reserve torque is significant only in a situation in which a level of the RPM decrease is 100 RPM or greater whereas the improvement effect is insignificant when the level of the RPM decrease is in a range of 50 to 60 RPM. Further, unlike combustion control, the reserve torque is preferably not used in terms of fuel efficiency, but the reserve torque should be minimally used if necessary.

SUMMARY

An exemplary embodiment of the present invention is directed to a method for controlling an air-fuel ratio in an idle purge-off mode, which is capable of resolving a revolutions per minute (RPM) decrease occurring in an idle purge-off mode through freeze control of a lambda control value and improving fuel efficiency by reducing a reserve torque required during purging through the resolving of the RPM decrease.

Other objects and advantages of the present invention may be understood by the following description and become apparent with reference to the exemplary of the present invention. Also, it is obvious to those skilled in the art to which the present invention pertains that the objects and advantages of the present invention may be realized by the means as claimed and combinations thereof.

In accordance with an exemplary embodiment of the present invention, a method for controlling an air-fuel ratio in an idle purge-off mode may include stopping feedback for an amount of fuel for a particular period of time when idle purging is terminated, and performing freeze control with a constant lambda control value. The freeze control may be performed when purge learning is not properly performed in a high concentration canister situation.

Additionally, the freeze control may be performed when a current state is an idle state, a current situation is not an evaporated gas leak diagnosis situation, and each of a purge concentration learning value and a lambda control value is equal to or less than a set value. The constant lambda control value may be a lambda control value at the beginning of purging. The particular period of time may be determined based on the lambda control value at the beginning of purging.

The method may further include setting the particular period of time to be less than 0 to deactivate the performing of the freeze control when the lambda control value at the beginning of purging is minimal and thus occurrence of a lean peak is inevitable even through the performing of the freeze control is performed. The constant lambda control value may be a lambda control value determined according to a level of the air-fuel ratio. The lambda control value determined according to a level of the air-fuel ratio may be a value that is greater than 1.

In accordance with another exemplary embodiment of the present invention, a method for controlling an air-fuel ratio in an idle purge-off mode may include executing a purge-on mode in which purging of a canister begins, storing a lambda control value at a start time of the purging, executing a purge-off mode in which a purge-off occurs, determining a condition for performing freeze control of stopping feedback for an amount of fuel for a particular period of time and adjusting the air-fuel ratio with a constant lambda control value, setting a freeze control time in which a start time and a release time for performing the freeze control are set, and performing the freeze control for a time between the start time and the release time.

The determining of the condition for performing the freeze control may include determining whether a current state is an idle state, whether a current situation is an evaporated gas leak diagnosis situation, and each of a purge concentration learning value and a lambda control value is less than or equal to a set value, and determining whether to perform the freeze control. The setting of the freeze control time may include determining the start time and the release time based on a lambda control value stored in the storing of the lambda control value. Further, the method may further include setting the start time to be greater than the release time to deactivate the performing of the freeze control when the lambda control value stored in the storing of the lambda control value is minimal and thus occurrence of a lean peak is inevitable even through the performing of the freeze control is performed.

In accordance with still another exemplary embodiment of the present invention, a method for controlling an air-fuel ratio in an idle purge-off mode may include executing a purge-on mode in which purging of a canister begins, executing a purge-off mode in which a purge-off occurs, determining a condition for performing freeze control of stopping feedback for an amount of fuel for a certain period of time and adjusting the air-fuel ratio with a constant lambda control value, and performing the freeze control.

The freeze control may be performed with the constant lambda control value determined according to a level of the air-fuel ratio, for a particular period of time. The lambda control value determined according to a level of the air-fuel ratio may be a value greater than 1.

BRIEF DESCRIPTION OF THE DRAWINGS

The above and other features of the present invention will now be described in detail with reference to certain exemplary embodiments thereof illustrated in the accompanying drawings which are given hereinbelow by way of illustration only, and thus are not limitative of the present invention, and wherein.

DETAILED DESCRIPTION

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

Although exemplary embodiment is described as using a plurality of units to perform the exemplary process, it is understood that the exemplary processes may also be performed by one or plurality of modules. Additionally, it is understood that the term controller/control unit refers to a hardware device that includes a memory and a processor. The memory is configured to store the modules and the processor is specifically configured to execute said modules to perform one or more processes which are described further below.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Hereinafter, a method for controlling an air-fuel ratio in an idle purge-off mode according to the present invention will be described in detail with reference to the accompanying drawings. However, if it is determined that known functions and configurations may unnecessarily obscure the gist of the present invention, detailed descriptions thereof will be omitted.

Figure 2:
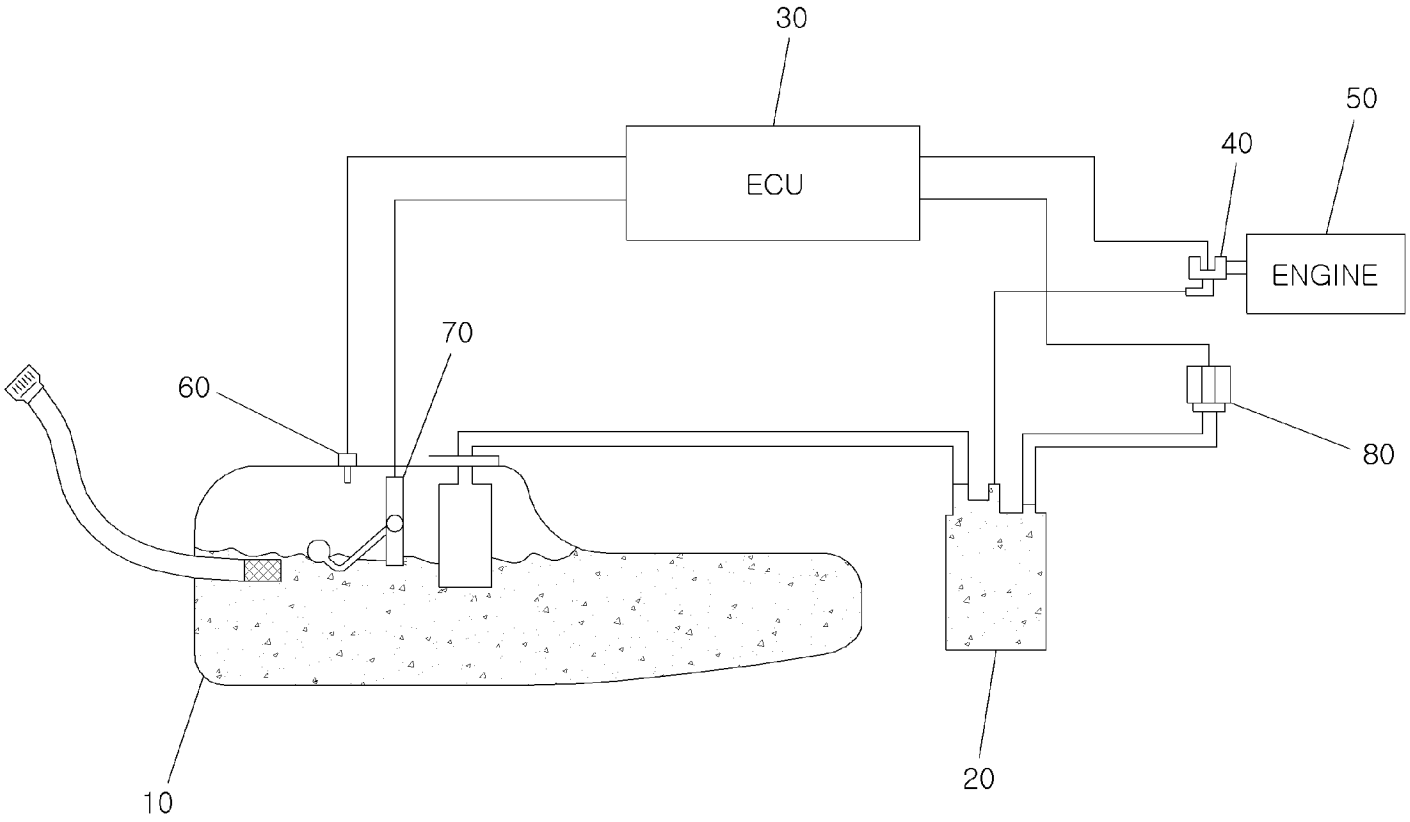
FIG. 2 is a configurational diagram of an evaporative emission system according to the related art.

FIG. 2 is a configurational diagram of an evaporative emission system. Referring to FIG. 2, evaporated gas generated in a fuel tank 10 may be collected in a canister 20, and when an engine 50 operates, purge gas flows into the engine 50 by a difference in pressure between a manifold (not shown) and the canister 20 when a purge control solenoid valve (PCSV) 40 is opened under the control of an electronic control unit (ECU) 30.

Since the purge gas is a mixture of fuel and air, an amount of fuel injection is reduced by an amount of fuel contained in the purge gas, and an amount of air contained in the purge gas is added in calculating of a charge amount. In FIG. 2, an undescribed reference numeral 60 denotes a pressure sensor, an undescribed reference numeral 70 denotes a fuel level sensor, and an undescribed reference numeral 80 denotes a canister vent solenoid.

Figure 1:
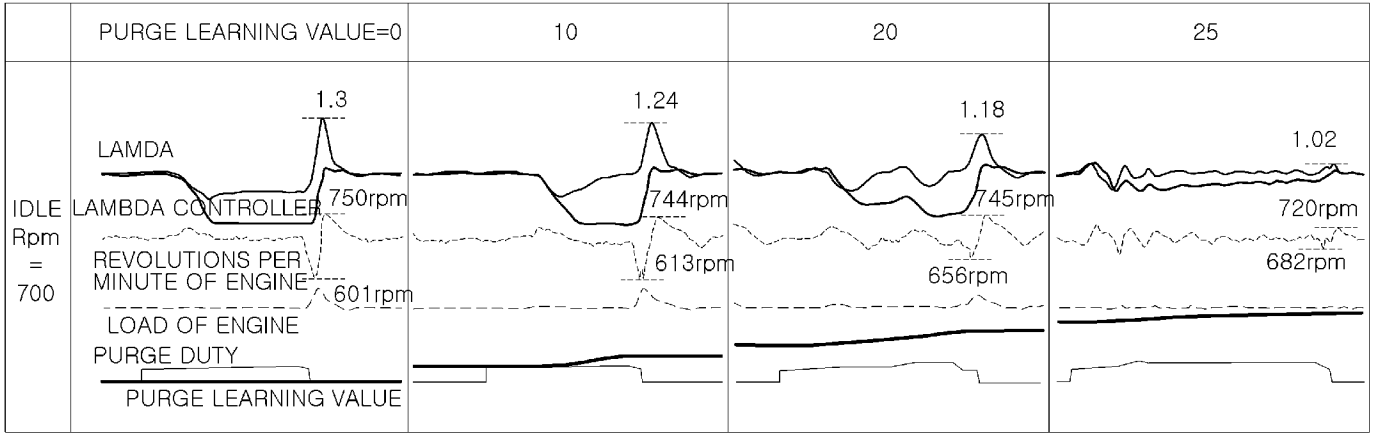
FIG. 1 is a graph of experimental data illustrating a revolutions per minute (RPM) decrease phenomenon in an idle purge-off mode according to a progress state of a purge learning according to the related art.

Learning a purge concentration in the canister 20 may be performed using the behavior of an oxygen sensor during purging, and when a purge valve is closed before the learning of the purge concentration in the canister 20 is completed in an idle high concentration canister situation, a revolutions per minute (RPM) decrease occurs due to a lean peak of an air-fuel ratio (see FIG. 1), and in the worst case, the engine 50 may be stalled.

In other words, when purge concentration learning is not completed, information regarding an amount of fuel flowing in during purging is inaccurate and thus a control deviation in air-fuel ratio occurs, such that a lambda control value (=a target amount of fuel injection/a current amount of fuel injection), which increases or decreases an amount of fuel injection during air-fuel ratio control, has a value (less than 1) for decreasing the amount of fuel injection, and in this state, when a purge-off mode is abruptly executed, an inflow of rich purge gas may be blocked instantaneously and the air-fuel ratio control may be performed by only a fuel injection, and at this point, a physical delay corresponding to a combustion process occurs inevitably in the process of receiving feedback from an oxygen sensor such that, in this transient section, the lean peak of the air-fuel ratio occurs and an RPM oscillates.

Such a phenomenon may be difficult to be completely improved even through a reserve torque is increased as in the related art, and therefore, according to the present invention, feedback for an amount of fuel is stopped for a predetermined time when the purging is terminated and the air-fuel ratio control may be performed with a predetermined lambda control value such that an RPM decrease phenomenon is more effectively improved through freeze control of the lambda control value.

Figure 3:
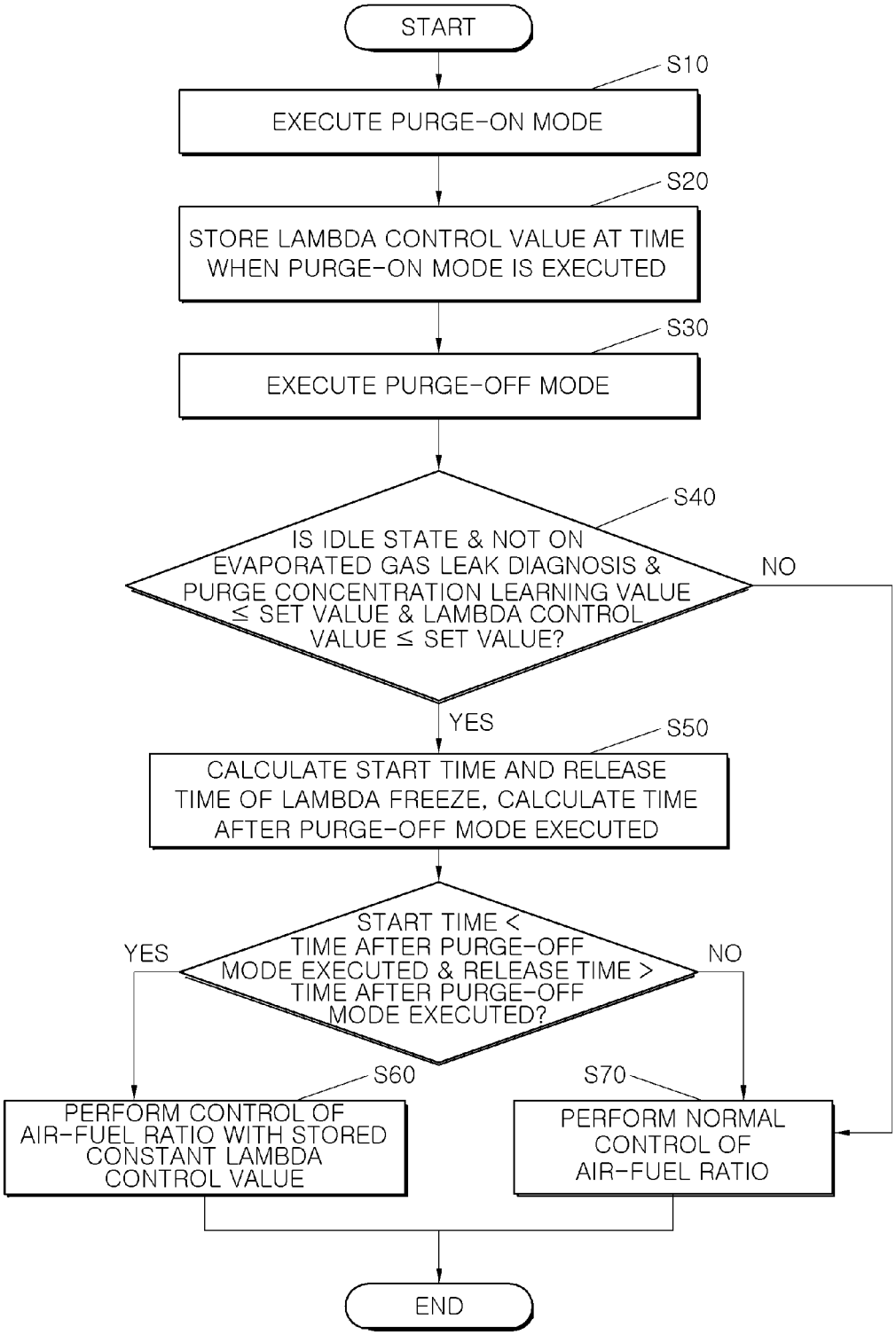
FIG. 3 is a flowchart illustrating a method for controlling an air-fuel ratio in an idle purge-off mode according to a first exemplary embodiment of the present invention.

FIG. 3 is a flowchart illustrating a method for controlling an air-fuel ratio in an idle purge-off mode according to a first exemplary embodiment of the present invention. The method described herein below may be executed by a controller having a processor and a memory. Referring to FIG. 3, the method for controlling an air-fuel ratio in an idle purge-off mode according to the first exemplary embodiment of the present invention may include executing a purge-on mode (S10), storing a lambda control value (S20), executing a purge-off mode (S30), determining a freeze control execution condition (S40), setting a freeze control time (S50), performing freeze control (S60), and performing normal feedback control (S70).

The method for controlling an air-fuel ratio in an idle purge-off mode according to the first exemplary embodiment of the present invention may begin purging of a canister in the executing of the purge-on mode (S10), a lambda control value at a beginning time in the storing of the lambda control value (S20), and determines whether to perform freeze control in the determination of the freeze control execution condition (S40) when a purge-off mode is executed in the executing of the purge-off mode (S30).

At this point, since an RPM decrease occurs significantly in an idle purge-off mode when purge learning is not properly performed in a high concentration canister situation, in the determination of the freeze control execution condition (S40), whether a current state is an idle state, whether a current situation is an evaporated gas leak diagnosis situation, and whether each of a purge concentration learning value and a lambda control value is equal to or less than a set value are determined and then whether to perform the freeze control may be determined.

When all the conditions are satisfied in the determination of the freeze control execution condition (S40), a start time and a release time for the freeze control may be set in the setting of the freeze control time (S50), a time after the purge-off mode may be calculated and the performing of the freeze control (S60) may be performed between the start time and the release time of the freeze control, and the performing of the normal feedback control (S70) may be performed during a time except for the time between the start time and the release time of the freeze control.

At this point, the start time and the release time of the freeze control may be determined based on the lambda control value stored at the beginning of purging. When the lambda control value stored at the beginning of purging, is high (for example, more than 1.11), the start time of the freeze control may be artificially set to be greater than the release time of the freeze control to prevent the performing of the freeze control (S60) from being performed.

Figure 4:
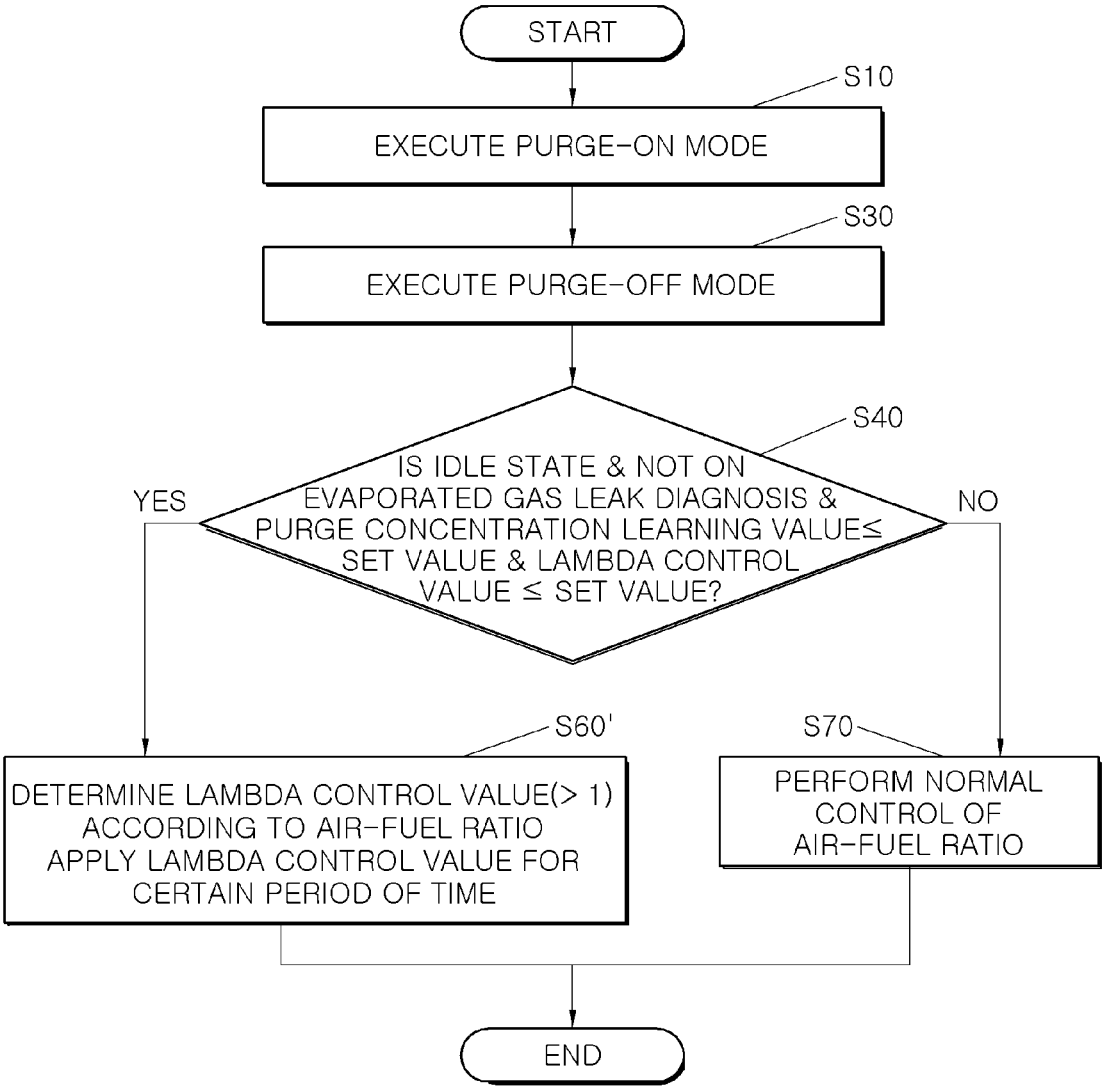
FIG. 4 is a flowchart illustrating a method for controlling an air-fuel ratio in an idle purge-off mode according to a second exemplary embodiment of the present invention.

FIG. 4 is a flowchart illustrating a method for controlling an air-fuel ratio in an idle purge-off mode according to a second exemplary embodiment of the present invention. Referring to FIG. 4, the method for controlling an air-fuel ratio in an idle purge-off mode according to the second exemplary embodiment of the present invention may include executing a purge-on mode (S10), executing a purge-off mode (S30), determining a freeze control execution condition (S40), performing freeze control (S60'), and performing normal feedback control (S70).

When compared to the first exemplary embodiment of the present invention, the second exemplary embodiment of the present invention has differences in that the storing of the lambda control value (S20) and the setting of the freeze control time (S50) may be omitted, and in the performing of the freeze control (S60'), the freeze control may be performed with a lambda control value determined based on a level of the air-fuel ratio instead of the lambda control value stored at the beginning of the purging for a particular period of time. In the second exemplary embodiment, the lambda control value determined based on the level of the air-fuel ratio level has a value that is greater than 1.

A fundamental concept of the second exemplary embodiment of the present invention is similar to that of the first exemplary embodiment thereof in that the freeze control may be performed with a constant lambda control value for a particular period of time in the idle purge-off mode to perform fuel amount control more rapidly.

As described above, in accordance with the method for controlling an air-fuel ratio in an idle purge-off mode according to the present invention, since the fuel amount control may be performed more rapidly in the idle purge-off mode, the RPM decrease phenomenon may be improved and discomfort of a driver feeling may be prevented in terms of noise and vibration to thus improve quietness while the engine operates and marketability may be improved accordingly.

Further, the method of the present invention may effectively respond to an RPM decrease in a range of about 50 to 60 RPM, which may be unable to be improved even though the reserve torque is increased during the purging, and may be selectively used when the purge concentration learning is not complete in the idle high concentration canister situation, such that a normal reserve torque, which is set to a high level in consideration of such a case, may be set to a minimum level.

In other words, since the control according to the related art is performed to increase the reserve torque for stable combustion control during purging, an unnecessary reserve torque was requested in some cases. However, the present invention may reduce a request level for the normal reserve torque, thereby reducing overall usage of the reserve torque while a vehicle is being driven and thus fuel efficiency may be improved.

In accordance with the method for controlling an air-fuel ratio in an idle purge-off mode according to the present invention, since the fuel amount control may be performed more rapidly in the idle purge-off mode, the RPM decrease phenomenon may be improved and discomfort of a driver feeling may be prevented in terms of noise and vibration thus improving quietness while the engine operates and marketability may be improved. Further, the method of the present invention may effectively response to a RPM decrease in a range of 50 to 60 RPM, which cannot be improved even though the reserve torque is increased during the purging, and reduce overall usage of the reserve torque while a vehicle is being driven to achieve improvement of fuel efficiency.

What is claimed is:

1. A method for controlling an air-fuel ratio in an idle purge-off mode, comprising the steps of:

executing, by a controller, a purge-on mode in which purging of a canister begins;

storing, by the controller, a constant lambda control value at a start time of the purging;

executing, by the controller, a purge-off mode in which a purge-off occurs;

determining, by the controller, a condition for performing a freeze control where feedback for an amount of fuel injection is stopped for a particular period of time when the purge-off occurs and the air-fuel ratio is adjusted with the constant lambda control value at a beginning of the purging;

setting, by the controller, a freeze control time in which a start time and a release time for performing the freeze control are set based on the constant lambda control value stored in the storing step; and performing, by the controller, the freeze control with the constant lambda control value for a time between the start time and the release time.

2. The method of claim 1, wherein the determining step further includes determining, by the controller, whether a current state is an idle state, whether a current situation is an evaporated gas leak diagnosis situation, and each of a purge concentration learning value and the constant lambda control value is less than or equal to a set value.

3. The method of claim 1, wherein the setting step includes setting, by the controller, the start time to be greater than the release time to deactivate the performing of the freeze control when the constant lambda control value stored in the storing step is a minimal value and occurrence of a lean peak is inevitable even though the performing of the freeze control is performed.

4. The method of claim 1, wherein the freeze control is performed when purge learning is performed insufficiently in a high concentration canister situation.

5. The method of claim 1, wherein the freeze control is performed when a current state is an idle state, a current situation is not an evaporated gas leak diagnosis situation, and each of a purge concentration learning value and the constant lambda control value is equal to or less than a set value.

6. The method of claim 5, wherein learning a purge concentration in the canister is performed using a behavior of an oxygen sensor during the purging.

7. The method of claim 1, wherein the particular period of time is determined based on the constant lambda control value at the beginning of the purging.

8. The method of claim 1, further comprising:

setting, by the controller, the particular period of time to be less than 0 to deactivate the performing of the freeze control when the constant lambda control value at the beginning of the purging is a minimal value and occurrence of a lean peak is inevitable even through the performing of the freeze control is performed.

9. The method of claim 1, wherein the constant lambda control value is determined based on a level of the air-fuel ratio.

10. The method of claim 9, wherein the constant lambda control value determined based on a level of the air-fuel ratio is greater than 1.

11. A method for controlling an air-fuel ratio in an idle purge-off mode, comprising the steps of:

executing, by a controller, a purge-on mode in which purging of a canister begins;

executing, by the controller, a purge-off mode in which a purge-off occurs;

determining, by the controller, a condition for performing a freeze control where feedback for an amount of fuel injection is stopped for a particular period of time when the purge-off occurs and the air-fuel ratio is adjusted with a constant lambda control value at a beginning of the purging; and performing, by the controller, the freeze control with the constant lambda control value.

12. The method of claim 11, wherein the constant lambda control value is determined based on a level of the air-fuel ratio for the particular period of time.

13. The method of claim 12, wherein the constant lambda control value determined based on a level of the air-fuel ratio is greater than 1.

* * * * *